US011369973B2

(12) United States Patent
Vashkovskyi et al.

(10) Patent No.: US 11,369,973 B2
(45) Date of Patent: Jun. 28, 2022

(54) METHOD AND DEVICE FOR MILLING AND SEPARATION OF SOLIDS AND GRANULAR MATERIALS INCLUDING METAL CONTAINING MATERIALS AS WELL AS PHYTOGENIC MATERIALS WITH HIGH LEVEL OF SILICON IN A CONTROLLED AIRFLOW

(71) Applicants: Kostiantyn Vashkovskyi, Fort Myers, FL (US); Andrii Seleznov, Krivoy Rog (UA)

(72) Inventors: Kostiantyn Vashkovskyi, Fort Myers, FL (US); Andrii Seleznov, Krivoy Rog (UA)

(73) Assignee: Eco Tec Mineria Corp., Fort Myers, FL (US)

( * ) Notice: Subject to any disclaimer, the term of this patent is extended or adjusted under 35 U.S.C. 154(b) by 407 days.

(21) Appl. No.: 15/813,093

(22) Filed: Nov. 14, 2017

(65) Prior Publication Data

US 2018/0147578 A1 May 31, 2018

(51) Int. Cl.

| | |
|---|---|
| ***B02C 23/30*** | (2006.01) |
| ***B02C 13/286*** | (2006.01) |
| ***B02C 13/288*** | (2006.01) |
| ***B02C 23/32*** | (2006.01) |
| ***B02C 13/28*** | (2006.01) |
| ***B02C 13/18*** | (2006.01) |

(52) U.S. Cl.

CPC ..... *B02C 23/30* (2013.01); *B02C 13/18* (2013.01); *B02C 13/2804* (2013.01); *B02C 13/286* (2013.01); *B02C 13/288* (2013.01); *B02C 23/32* (2013.01); *B02C 2013/28609* (2013.01)

(58) Field of Classification Search

CPC ..... B02C 23/30; B02C 13/286; B02C 13/288; B02C 23/32; B02C 13/2804; B02C 13/18; B02C 2013/28609

See application file for complete search history.

(56) References Cited

U.S. PATENT DOCUMENTS 4,560,534 A * 12/1985 Kung ..... C12Q 1/006 422/82.02
4,690,338 A * 9/1987 Sayler ..... B02C 13/18 241/154

(Continued)

*Primary Examiner* — Kevin R Kruer

(57) ABSTRACT

The invention relates to the method and device for milling and separation into fractions of solids and granular materials in a controlled airflow. The device for milling and separation of solids and granular materials consists of a round milling chamber with a system of pneumatic separation comprising of a vertical cylindrical body that has an uploading slot for solids and granular materials and unloading channels for the milled products of light, medium and coarse fractions. A rotating disc and a conical divider are located inside the vertical cylindrical body. The rotating disc has removable hammers and removable blades of different sizes and configurations. The system of pneumatic separation consists of a milling chamber, an air slugcatcher, channels for the milled material, and a chamber of higher pressure. Such a construction of the device allows to obtain products of the highest quality, and to improve the separation by dividing the material into three fractions: light, medium and coarse.

9 Claims, 5 Drawing Sheets

(56) References Cited

U.S. PATENT DOCUMENTS 4,749,133 A * 6/1988 Sayler ..... B02C 23/28 110/106
5,192,029 A * 3/1993 Harris ..... B02C 13/14 241/154
5,662,279 A * 9/1997 Czekai ..... B02C 17/161 241/21
5,695,130 A * 12/1997 Csendes ..... B02C 19/005 241/19
5,826,807 A * 10/1998 Csendes ..... B01D 45/14 241/19
5,839,671 A * 11/1998 Sand ..... B02C 13/16 241/24.1
5,850,977 A * 12/1998 Csendes ..... B01D 45/14 241/17
5,900,604 A * 5/1999 McNeill ..... B03B 9/00 209/12.1
6,227,473 B1 * 5/2001 Arnold ..... B02C 13/18 241/1
6,270,708 B1 * 8/2001 Gurol ..... B02C 13/18 264/117
6,325,306 B1 * 12/2001 Gacanich ..... B02C 13/18 241/15
6,443,376 B1 * 9/2002 Huang ..... B02C 13/14 241/52
6,691,939 B2 * 2/2004 Grimes ..... A47L 5/38 241/46.17
7,108,207 B2 * 9/2006 Waznys ..... B02C 2/10 241/23
7,124,968 B2 * 10/2006 Oder ..... B02C 15/04 241/18
7,530,513 B2 * 5/2009 Tessier ..... B02C 13/1814 241/275
7,891,593 B2 * 2/2011 Gronholz ..... B02C 13/14 241/188.1
9,403,167 B2 * 8/2016 Watts ..... B02C 23/28
9,498,780 B2 * 11/2016 Watts ..... B02C 13/282
9,707,564 B2 * 7/2017 Mogan ..... B02C 13/28
10,449,544 B2 * 10/2019 Watts ..... B02C 23/10
2002/0179751 A1 * 12/2002 Kantonen ..... B02C 13/16 241/19
2009/0101739 A1 * 4/2009 Bu ..... B02C 18/0084 241/24.1
2010/0140384 A1 * 6/2010 Webb ..... B02C 13/18 241/79
2010/0327096 A1 * 12/2010 Watts ..... B02C 13/1814 241/56
2011/0101141 A1 * 5/2011 Koslow ..... B02C 13/16 241/195
2012/0119003 A1 * 5/2012 Watts ..... B02C 13/09 241/30
2014/0077010 A1 * 3/2014 Watts ..... B02C 13/14 241/55
2014/0151473 A1 * 6/2014 Boltersdorf ..... D21B 1/322 241/24.13
2014/0154080 A1 * 6/2014 Watts ..... B02C 13/1814 416/185
2014/0166795 A1 * 6/2014 Mogan ..... B02C 13/28 241/191
2015/0034747 A1 * 2/2015 Watts ..... B02C 13/288 241/55
2016/0045919 A1 * 2/2016 McDaniel ..... B02C 13/18 241/191
2016/0121333 A1 * 5/2016 Pallman ..... B02C 13/1835 241/18
2016/0144371 A1 * 5/2016 Sontag ..... B02C 13/14 241/56
2016/0144375 A1 * 5/2016 Dallimore ..... B02C 13/286 241/5

* cited by examiner

METHOD AND DEVICE FOR MILLING AND SEPARATION OF SOLIDS AND GRANULAR MATERIALS INCLUDING METAL CONTAINING MATERIALS AS WELL AS PHYTOGENIC MATERIALS WITH HIGH LEVEL OF SILICON IN A CONTROLLED AIRFLOW

BACKGROUND OF THE INVENTION

The invention relates to the field of processing of solids and granular materials in metallurgy and other industries where milling of materials and its separation are required (including metal containing materials, as well as phytogenic materials with high level of silicon).

Rotaries of centrifugal percussive mills are known where a milling chamber consists of a vertical cylindrical body with an uploading axial channel for metal-containing material and unloading channels for the milled material, inside of which a rotating disc is installed on a vertical shaft. The rotating disc has blades radially installed on its upper surface with carbide-tipped electrodes welded onto the sides of the blades.

Also, centrifugal percussive mills are known where a milling chamber consists of a vertical cylindrical body with an uploading axial channel for metal containing material and unloading channels for the milled material of light and heavy fractions, inside of which a rotating disc is installed on a vertical shaft. The rotating disc has blades radially installed on its upper surface with carbide-tipped elements welded onto the sides thereof. There is a divider installed inside the body of such milling chamber.

Common disadvantages of these mills are their low reliability and low productivity caused by possible clinches and breakdowns of the device when a piece of material exceeding a gap between the wall of the milling chamber and the rotating disc, falls into that gap. Also, when the moisture content of the material exceeds 5%, then the operational sections of the rotating disc and the milling chamber are cemented with the material being milled until self-clinching and imbalance of the rotating disc occur. Such mills do not separate the material into fractions at all.

The use of the present device improves the quality of milling by obtaining the finest fraction of the product being milled and by excluding self-sealing of the material being milled to the operational parts of the device. It improves the quality of separation of the material by dividing the obtained product into three fractions: light, medium and coarse. The device also mills any hard material including phytogenic material with high level of silicon. It increases the reliability and the service life of the device. Same time, it reduces manufacturing costs and maintenance time of the device.

Therefore, the task of this invention is to improve the already existing devices for milling and separation of solids and granular materials including metal containing materials, as well as phytogenic materials with high level of silicon, by changing the structure of the device elements; to eliminate the process of self-sealing of the material being milled; to achieve more efficient separation of the product in the milling chamber and in the air slugcatcher; to minimize wear of anti-abrasive pads installed to the edge of the rotating disc and to the peripheral part of the chamber of higher pressure by increasing the air flow by enlarging the length and the width of the removable blades installed in the lower part of the rotating disc. This will improve the device reliability and durability, and will increase the quality of the finished product.

This task is solved in accordance with the invented method and using the device described below. The preferred embodiments of the invention and the equipment of the invention form the subject of the claims of this invention.

According to the invention, the device for milling and separation of solids and granular materials including metal containing materials, as well as phytogenic materials with high level of silicon, in a controlled airflow consists of a milling chamber with a system of pneumatic separation. The device comprises a vertical cylindrical body with an uploading axial slot and an uploading channel for the original material, an upper and a lower unloading channels for a milled material of light fraction, an unloading channel for a milled material of medium fraction, an unloading channel for a milled material of coarse fraction. A rotating disc is installed on a bearing unit inside the said vertical cylindrical body, with removable hammers radially installed on an upper surface of the rotating disc. Carbide-tipped electrodes are welded onto the sides of the hammers. Also, a conical divider is installed inside the vertical cylindrical body. Carbide-tipped electrodes are welded to a lower working edge thereof. Removable blades located in the lower part of the rotating disc are enlarged to create more air pressure between anti-abrasive pads located on the edge of the rotating disc and on the peripheral part of the chamber of higher pressure, thereby preventing bigger particles of the material from getting into a gap between the rotating disc and a wall of the milling chamber. A plurality of bumpers are radially located on an upper wall of the milling chamber. A circular ledge is installed along a periphery of the upper surface of the rotating disc. The removable hammers abut the circular ledge. The inner surface of the circular ledge is interfaced, in sections between the hammers, with the upper surface of the rotating disc along an inclined plane. The system of pneumatic separation comprises a milling chamber coupled with an air slugcatcher, an upper and a lower channels for a milled material of light fraction, a vertical tubular channel connected to the unloading channel for the milled material of medium fraction, and an upper part of the unloading channel for the milled material of medium fraction. The said unloading channel for the milled material of medium fraction is located in a peripheral part of an upper end wall of a body of the milling chamber. The system of pneumatic separation also includes a chamber of higher pressure created in a gap between the rotating disc and a lower end wall of the body of the milling chamber with a slot. The air intake is fulfilled through the controlled air supply control valve. Removable hammers have different lengths and configurations. Carbide-tipped electrodes are welded onto the sides thereof. The hammers can be changed depending on the material being processed. The angle of inclination of the conical divider is no less than 45 degrees, and the unloading channel for the milled material of coarse fraction is located in a peripheral part of a lower end wall of the body of the milling chamber. The circular ledge of the rotating disc is set at the same height as the removable hammers, or higher. Maximum dimensions of the hammers are set experimentally taking into account the active zone of destruction of the original material. An optimal working gap is provided between a wall of the milling chamber and the hammers when the bottom diameter of the conical divider is no more than ⅔ part of the diameter of the rotating disc. The most efficient circulation of the material being milled in the milling chamber is provided when the angle of inclination of the conical divider is no less than 45 degrees. During such a process, sticking and self-sealing of the material being milled to the working parts is not observed. Installation of the circular ledge along the circumference of the rotating disc, against which the hammers abut, and the inner surface of which is interfaced, in sections between the hammers, with the upper surface of the rotating disc along an inclined plane, provides, during the process of milling of the original material, the return of unprocessed material into the milling chamber by cyclically blowing the material being milled, where the unprocessed material of coarse fraction bounces off the inclined plane and the circular ledge toward the surface of the conical divider. As a result, the material being milled is supplied to the active zone of the milling chamber and separated as milled. This process provides an optimal mode of cyclic milling of the original material, and its separation. Installation of the hammers at the same height as the circular ledge provides an optimal mode of milling of the original material where sticking of the material to the working parts and self-sealing of the material being milled to the operational zone are not observed. Hammers of various lengths and configurations are used in the system experimentally, depending on the material being processed. This allows to mill the hardest materials including phytogenic materials with high level of silicon. It greatly improves the quality of the finished product.

Anti-abrasive pads used in the device are made from high resistance alloy steel that protects the rotating disc and the body of the milling chamber. The installed air supply control valve improves the separation of light fraction and prolongs the expiration of anti-abrasive pads increasing the productivity of the device.

The upper part of the device is equipped with four new supporting stands, one of which is removable. Three stands are mounted to an upper part of the vertical cylindrical body firmly but the fourth stand is removable. New location of the support system allows to quickly separate the chamber of higher pressure and the rotating disc from the vertical cylindrical body of the device which reduces the maintenance costs and the repair time of the device.

The electric motor of the device is installed remotely and connected to a drive pulley by a belt drive. The drive pulley is cantilevered. The support system is made from a part of the stocking of the truck bridge, a hub and an axle shaft, which greatly simplifies the support system and reduces expenses. Also, it reduces the pressure onto the bearing unit, and increases the service life of the unit.

BRIEF DESCRIPTION OF THE DRAWINGS

Now, the invention will be described in more detail below with reference to the following drawings, whereby.

DETAILED DESCRIPTION OF THE INVENTION

Figure 1:
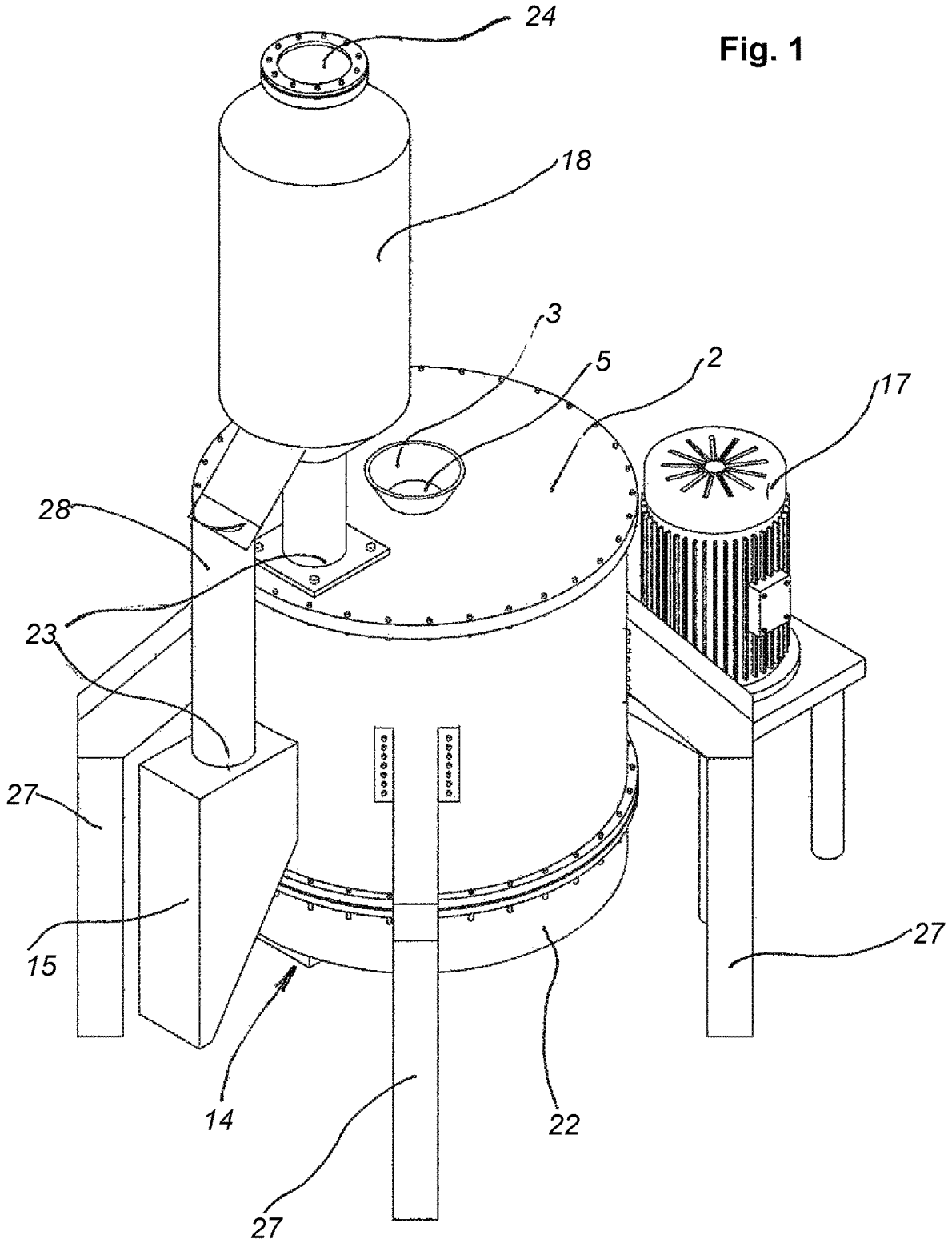
FIG. 1—shows a perspective view of the device for milling and separation of solids and granular materials including metal containing materials as well as phytogenic materials with high level of silicon in a controlled airflow.
Figure 2:
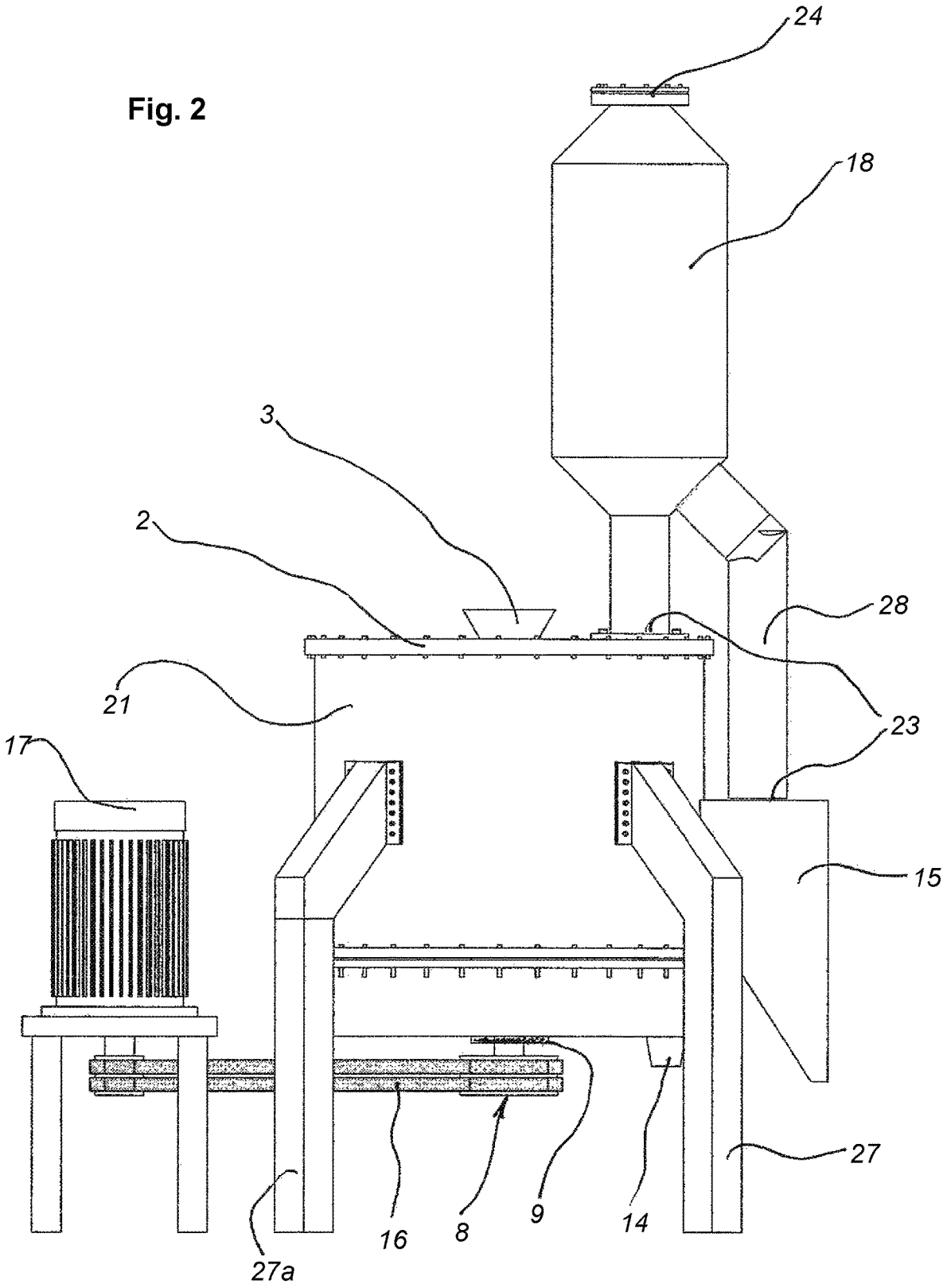
FIG. 2—side view of the device in accordance with FIG. 1.
Figure 3:
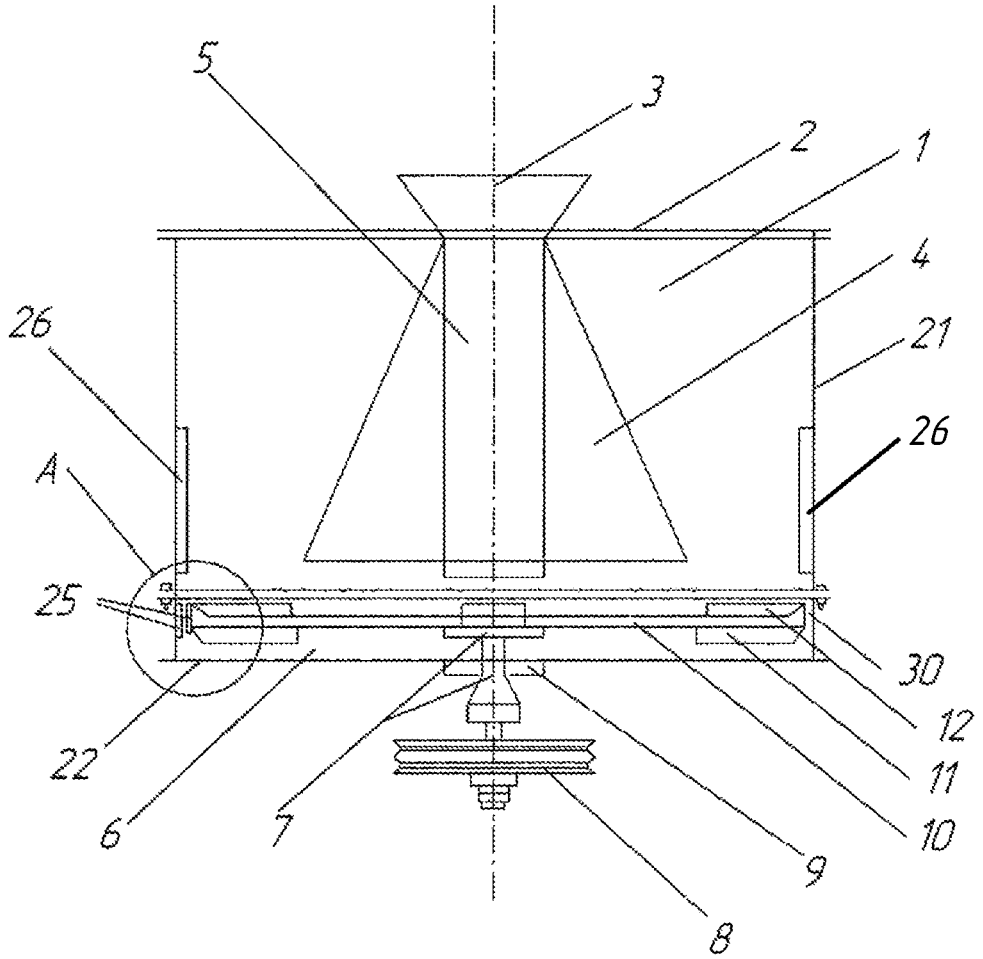
FIG. 3—shows a cross sectional view of the body of the device for milling and separation of solids and granular materials including metal containing materials, as well as phytogenic materials with high level of silicon according to FIG. 1 and FIG. 2.
Figure 4:
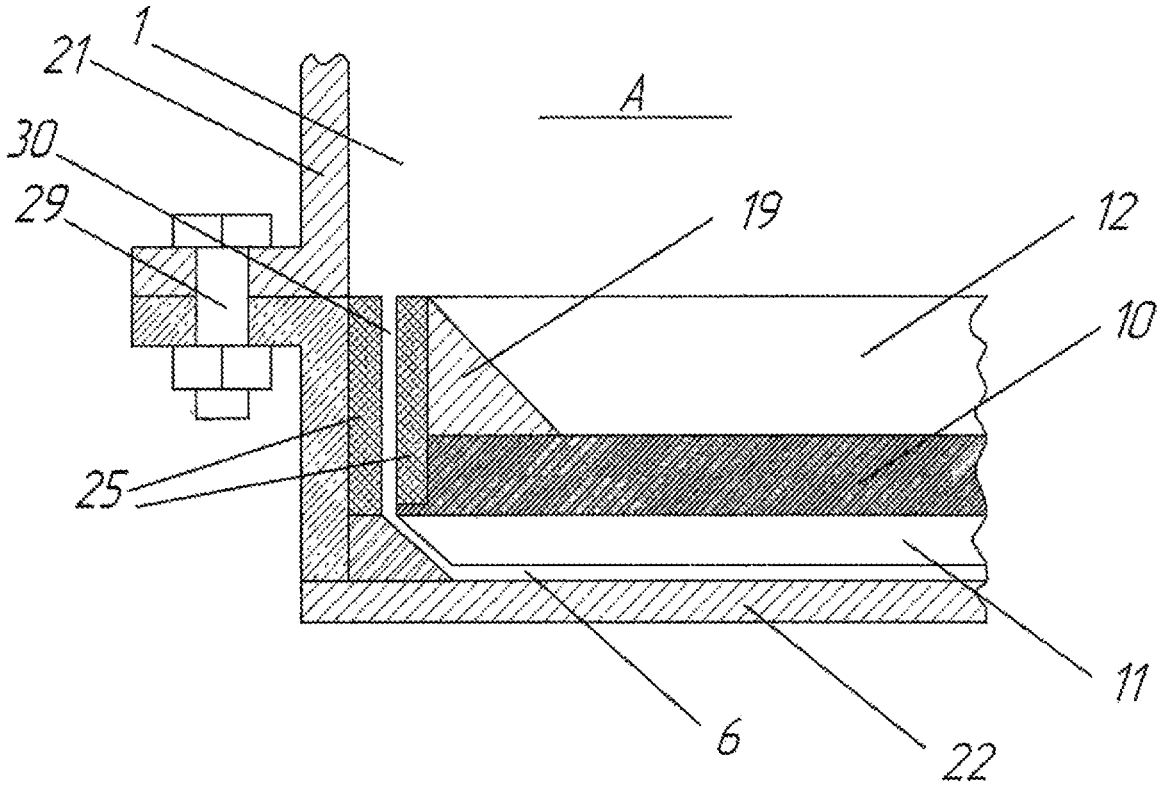
FIG. 4—shows a cross sectional view of a section A of a lower part of the vertical cylindrical body of the device according to FIG. 3.
Figure 5:
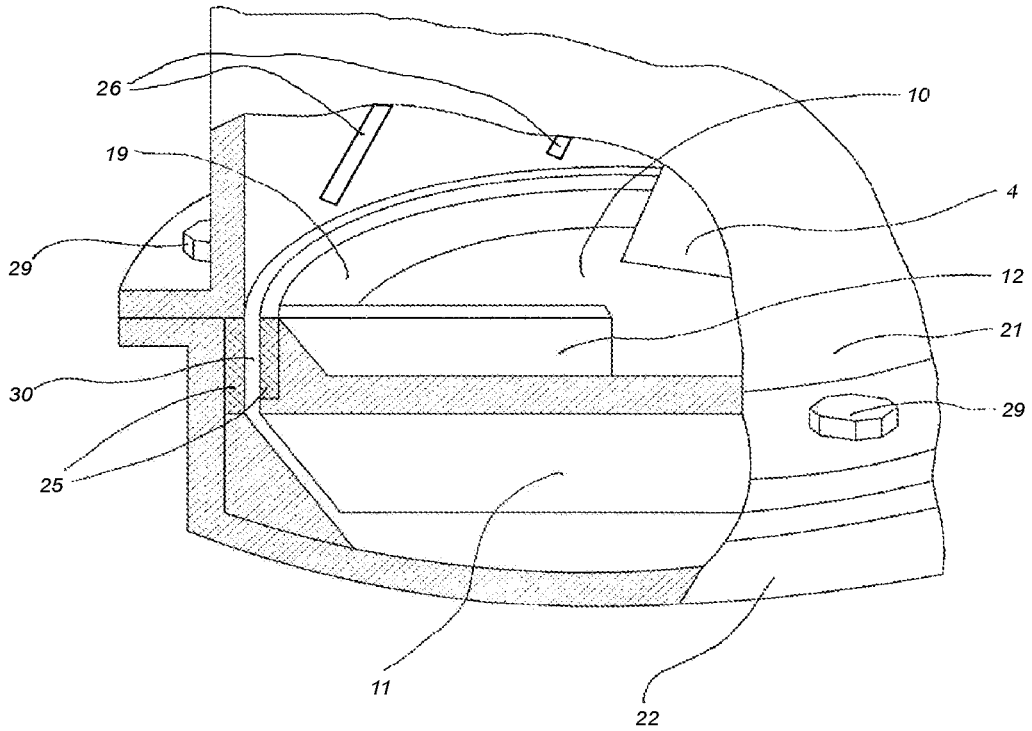
FIG. 5—shows a cross sectional view of a part of the rotating disc of FIG. 1.

Many specific details of certain embodiments of the invention are set forth in the following description and in FIGS. 1 through 5 to provide a thorough understanding of such embodiments. FIG. 1 shows a perspective view, FIG. 2 shows a side view and FIG. 3 shows a cross sectional view of the device for milling and separation of solids and granular materials including metal containing materials, as well as phytogenic materials with high level of silicon, in a controlled air flow. The device comprises a round milling chamber 1 (see FIG. 3) with a system of pneumatic separation. It consists of a vertical cylindrical body 21 that has an uploading axial slot 3 and an uploading channel 5 for the original material located on the upper surface of the vertical cylindrical body 21, an upper unloading channel 23 for a milled material of light fraction located on the upper surface of the vertical cylindrical body 21, a lower unloading channel 23 for a milled material of light fraction located on the upper surface of the unloading channel 15 for a milled material of medium fraction, an unloading channel 15 for a milled material of medium fraction located in a peripheral part of an upper end wall 22 of the body of the milling chamber 1, an unloading channel 14 for a milled material of coarse fraction located in the peripheral part of a lower end wall 22 of the body of the milling chamber 1. A drive pulley 8 of a belt drive 16 is installed on a bearing unit 7 under the body 21 of the milling chamber 1. A rotating disc 10 is installed on a bearing unit 7 in a lower part of the milling chamber 1. Removable hammers 12 of different lengths and configurations are radially installed on the upper surface of the rotating disc 10. Carbide-tipped electrodes are welded onto the sides of the removable hammers. A conical divider 4 is installed in the upper part of the milling chamber 1. Carbide-tipped electrodes are welded to a lower working edge thereof. The rotating disc 10 has removable blades 11 installed on its lower surface. The bumpers 26 (see FIG. 3 and FIG. 5) are radially located on an upper wall of the milling chamber 1. A circular ledge 19 (see FIG. 5) is installed along the periphery of the upper surface of the rotating disc 10. Removable hammers 12 abut the circular ledge 19. The inner surface of the circular ledge 19 is connected, in sections between the hammers 12, with the upper surface of the rotating disc 10 along an inclined plane.

The system of pneumatic separation comprises a milling chamber 1 coupled with an air slugcatcher 18, an upper and a lower unloading channels 23 for the milled material of light fraction, and a vertical tubular channel 28 connected to the unloading channel 15 for the milled material of medium fraction. Also, the system of pneumatic separation has a chamber of higher pressure 6 (see FIG. 3 and FIG. 4) created in a gap between the rotating disc 10 and a lower end wall 22 of a body 21 of the milling chamber 1. The body of the mentioned chamber communicates with the atmosphere through an air supply control valve 9. Removable hammers 12 have different lengths and configurations and are selected depending on the material being processed. Carbide-tipped electrodes are welded to the sides of the removable hammers 12. The bottom diameter of the conical divider 4 is no more than ⅔ part of the diameter of the rotating disc 10. The angle of inclination of the conical divider 4 is no less than 45 degrees. Carbide-tipped electrodes are welded to a lower working edge thereof. The unloading channel 14 for the milled material of coarse fraction is located in a peripheral part of the lower end wall 22 of the body 21 of the milling chamber 1. The circular ledge 19 of the rotating disc 10 is fulfilled at the same height as the hammers 12, or higher. An electric motor 17 rotates the rotating disc 10 by means of a belt drive 16, a drive pulley 8 and a bearing unit 7.

The device for milling and separation of solids and granular materials including metal containing materials, as well as phytogenic materials with high level of silicon, in a controlled air flow works as follows. Initially, the device for milling and separation of solids and granular materials including metal containing materials, as well as phytogenic materials with high level of silicon, in a controlled air flow is set to the initial working position. For this purpose, the electric motor 17 connected to the rotating disc 10 is switched on, and then the milling chamber 1 is loaded with a dosed material through the uploading axial slot 3 and the uploading channel 5. The material is discarded to the peripheral part of the rotating disc 10 by centrifugal force, where the plane of motion of the milled material changes from the horizontal to the inclined plane within a range from 50 to 60 degrees.

Wherein, the flight path of the material being milled is directed to the upper part of the milling chamber 1. This eliminates self-sealing of the material being milled on the wall of the milling chamber 1. Having reached the upper end wall 2 of the body 21 of the milling chamber 1, the material being milled is returned to the operational area of the milling chamber 1 under the influence of gravity and due to the elastic properties of particles by rolling along the surface of the conical divider 4 onto the hammers 12 of the rotating disc 10, colliding with other particles of the material being milled. The particles of the material being milled in the milling chamber 1 perform circular translational movements, as well as their own axial motion. Such a complicated movement of the particles of the material being milled in the milling chamber 1 provides the destruction of the particles, giving them a spherical shape. In particular, metal inclusions that are present in the original material, acquire such shape. The material milled to a pulverized or so-called light fraction, passes through the section of percussive loads and reaches the unloading channel 23 for the milled material of light fraction and then goes into the air slugcatcher 18 under the air pressure. The air flow in the chamber of higher pressure 6, under the pressure of which the pulverized light fraction of the milled material goes into the air slugcatcher 18 of the system of pneumatic separation through the unloading channel 23, is formed by the rotation of the removable blades 11 installed on the lower surface of the rotating disc 10. Wherein, air is sucked and pumped into the circular gap 30 between the anti-abrasive pads 25 (see FIG. 4) through the air supply control valve 9. Since the said circular gap communicates constantly with the chamber of higher pressure 6, the bigger particles of the material being milled return to the operational area of the milling chamber 1 by the pressure of the chamber of higher pressure 6 and the rotating disc 10 with the hammers 12 and the inclined plane of the circular ledge 19 (see FIG. 4). When solid metal pieces that are smaller than the gap between the anti-abrasive pads 25 (see FIG. 4) fall into that gap, they go into the unloading channel for the milled material of coarse fraction 14.

Thus, the possibility of a clinch of the rotating disc 10 and possible breakdowns of the device are eliminated. As the material being milled consists of both solid and soft minerals, it breaks down into very small (nonresistant and pulverized) and large (firm) particles under the influence of impact loads. As a result, these particles are divided into three flows in the system of pneumatic separation: coarse particles unload through the lower channel 14, medium particles unload through the channel 15 and smaller pulverized particles unload by the air flow through the diversion channels 23 to the air slugcatcher 18 where the separation of the lighter material is made again and it unloads through the channel 24. Bigger particles accumulated in the air slugcatcher 18, return to the milling chamber 1 where they are milled again. The length and the shape of the hammers are selected in accordance with the active zone for destruction of the original material under the influence of impact loads. The bottom diameter of the conical divider is no more than ⅔ part of the diameter of the rotating disc 10. The diameter is calculated on the basis that the formed area does not overlap the working area of the moving hammers 12. The angle of inclination of the conical divider 4 is no less than 45 degrees that ensures the rolling of the undermilled particles along the sides of the conical divider into the working area of the milling chamber 1. The upper part of the device is equipped with four stands 27, one of which is removable 27*a*. Three stands are mounted tightly to the body of the milling chamber 1 and one stand can be quickly removed together with the chamber of higher pressure 6 and the rotating disc 10 for maintenance and repairs, thereby reducing the time for dismounting and installation of the device.

What is claimed is:

1. A device for milling and separation of solids and granular materials comprising:

a vertical cylindrical body having a milling chamber with a system of pneumatic separation comprising a chamber of higher pressure created in a gap between a rotating disc and a lower end wall of the milling chamber, wherein the rotating disc has a diameter and is installed on a bearing unit inside the vertical cylindrical body, a circular ledge installed along a periphery of the upper surface of the rotating disc, an uploading axial slot located on top of said vertical cylindrical body attached to an uploading channel extending into said milling chamber, an upper and a lower unloading channels for a milled material of light fraction, wherein both the upper and lower unloading channels for the milled material of light fraction are coupled with an air slugcatcher, an unloading channel for a milled material of medium fraction located in a circumferential peripheral part of an upper end wall of the milling chamber, an unloading channel for a milled material of coarse fraction located in a circumferential peripheral part of a lower end wall of the milling chamber, a conical divider installed inside the vertical cylindrical body with carbide-tipped electrodes welded to a lower edge thereof, a plurality of removable hammers radially installed on an upper surface of the rotating disc, with carbide-tipped electrodes welded onto the sides of the hammers, wherein the removable hammers abut the circular ledge installed along the periphery of the upper surface of the rotating disc, a plurality of removable blades radially installed on a lower surface of the rotating disc, a support system and a remote electric motor.

2. The device for milling and separation of solids and granular materials of claim 1, wherein lengths and configurations of the removable hammers are selected based on the solids and granular materials being milled.

3. The device for milling and separation of solids and granular materials of claim 1, wherein lengths and widths of the removable blades are selected-to create a desired air pressure.

4. The device for milling and separation of solids and granular materials of claim 1, wherein an anti-abrasive pad is installed on an edge of the rotating disc and on a peripheral part of the chamber of higher pressure.

5. The device for milling and separation of solids and granular materials of claim 1, wherein an inner surface of the circular ledge is interfaced with the upper surface of the rotating disc along an inclined plane.

6. The device for milling and separation of solids and granular materials of claim 1, wherein an angle of inclination of the conical divider is no less than 45 degrees, and a bottom diameter of the conical divider is no more than ⅔ part of the diameter of the rotating disc.

7. The device for milling and separation of solids and granular materials of claim 1, wherein an air supply control valve flap is installed on a bottom surface of the vertical cylindrical body.

8. The device for milling and separation of solids and granular materials of claim 1, wherein the support system consists of four supporting stands mounted to the vertical cylindrical body and wherein one of said four supporting stands is removable from the vertical cylindrical body.

9. The device for milling and separation of solids and granular materials of claim 1, wherein the remote electric motor is connected to a drive pulley by a belt drive.

* * * * *